United States Patent [19]

Julian

[11] 3,993,209

[45] Nov. 23, 1976

[54] CHILD-RESISTANT CAP

[75] Inventor: Randall K. Julian, Evansville, Ind.

[73] Assignee: Sunbeam Plastics Corporation, Evansville, Ind.

[22] Filed: Dec. 24, 1975

[21] Appl. No.: 644,134

[52] U.S. Cl. ..... 215/216; 215/221

[51] Int. Cl.[2] ..... B65D 55/02; B65D 85/56; A61J 1/00

[58] Field of Search ..... 215/9, 216, 221, 330

[56] References Cited

UNITED STATES PATENTS

| | | | |
|---|---|---|---|
| 3,698,584 | 10/1972 | Miller | 215/216 |
| 3,881,624 | 5/1975 | Dougherty, Sr. | 215/221 |

*Primary Examiner*—George T. Hall

*Attorney, Agent, or Firm*—Henry K. Leonard

[57] ABSTRACT

A child-resistant cap and neck finish for a container. The cap has a disc-like top and a depending skirt. The cap skirt and container neck have mating threads, which may be single or multi-start. The cap skirt has a lower, generally annular, or slightly oval locking collar that is connected to the threaded skirt only by flexible webs. The cap skirt and collar are unitary. The collar and the container neck have cooperating child-resistant means which are disengaged by squeezing the collar radially inwardly from opposite sides to bulge it outwardly in the direction normal to the direction of squeezing. The child-resistant elements on the collar are thereby moved out of engagement with those on the container neck and the cap may be turned in a retrograde direction.

5 Claims, 11 Drawing Figures

CHILD-RESISTANT CAP

BACKGROUND OF THE INVENTION

Many types and styles of so-called child-proof or, more properly, child-resistant, closures have been suggested for containers in which dangerous or harmful products are packaged. Some types, such as snap-on caps, may be satisfactory for solid objects like pills or tablets but do not establish liquid tight seals when they are closed. Other types involving the use of mating threads on the cap and container neck have been suggested for packaging liquid materials, but most of these are either too complicated, comprise two or more separately moldable parts which must be assembled and are thus costly, or require extremely complicated molds thus increasing the cost of manufacture. Others more successful in retaining liquids in containers have been developed which place the mating threads in one concentric skirt and have the child-resistant locking means on other attached elements, therefore these closures require substantial quantities of the material from which they are fabricated and thus also are relatively costly.

It is, therefore, the principal object of the instant invention to provide a child-resistant cap and neck finish for a container which will be liquid tight when closed, which is a single unitary piece, which has effective threads for tightly sealing the container and a simple, yet effective, child-resistant locking means.

Yet another object of the instant invention is to provide a child-resistant cap and neck finish for a container wherein the container neck has threads of "standard pitch" and thus will accept a simple threaded cap of the type long used for closing containers but also can be utilized in combination with a child-resistant cap according to the invention when it is desired to make the closure child-resistant.

DESCRIPTION OF PREFERRED EMBODIMENTS

Figure 1:
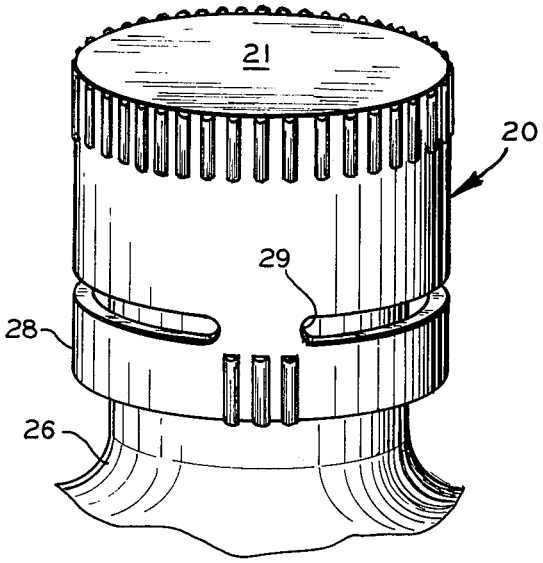
FIG. 1 is a fragmentary view in perspective of a first embodiment of the instant invention.
Figure 2:
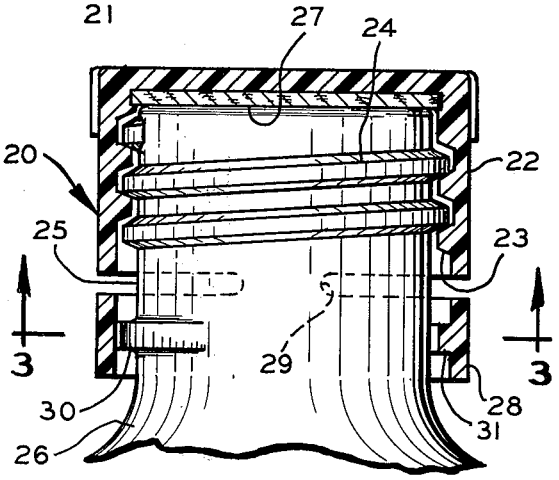
FIG. 2 is diametric, vertical sectional view of the embodiment shown in FIG. 1.

A first embodiment of the invention is illustrated in FIGS. 1 - 4, inclusive. In this embodiment a cap generally indicated by the reference No. 20 is illustrated as having a disc-like top 21 and a generally annular, depending skirt 22.

The inner side of the skirt 22 has conventional threads 23 which mate with threads 24 on a neck 25 of a container fragmentarily indicated by the reference No. 26. While a sealing liner 27 is shown interiorly of the cap top 21, any other conventional sealing means also may be utilized in a cap comprising an element of the invention or, if the cap is utilized or a container for solid materials, no liner or other sealing means may be required.

In this embodiment of the invention, the cap 20 also comprises a lower, generally annular locking collar 28 which has the same outside diameter as the cap skirt 22 and which is unitarily connected to the cap skirt 22 only by two axially extending webs 29.

Cooperating child-resistant locking means comprising opposed teeth 30 on the neck 25 and 31 on the collar 28 are so spaced vertically relative to the end of the neck 25 and the cap top 21 as to be overlapped with each other when the cap 20 is turned downwardly onto the container neck 25 to liquid sealing position. By reason of the opposed configuration of teeth 30 and 31, the teeth ratchet past each other until the cap 20 is tightly sealed on the neck 25 and finally engage each other as illustrated in FIG. 3 when the container is closed.

Figure 3:
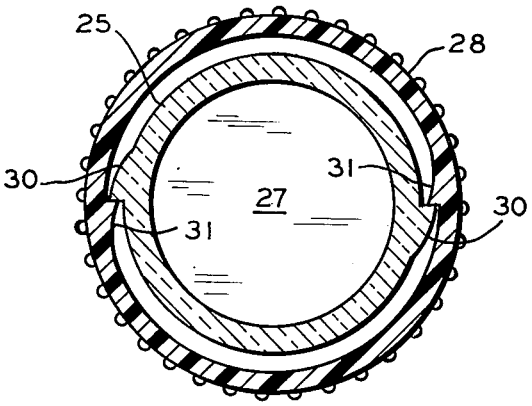
FIG. 3 is a horizontal sectional view taken along the line 3—3 of FIG. 2 and showing the cap in child-resistant position on the fragmentarily illustrated neck of a container.

It will be appreciated that, because of the flexible webs 29 which connect the collar 28 to the cap skirt 22, the skirt 28 can be deflected outwardly in order to allow the teeth 31 to pass the teeth 30 into the locking position shown in FIG. 3. Thus when the cap 20 is initially placed upon the container neck 25, for example by automatic capping machinery, or when the cap 20 is restored to the neck 25 after the container has been opened, even if the liner 27 is slightly compressed, and the cap 20 turns beyond the position illustrated in FIG. 3, the container is still locked against removal of the cap 20 by a small child.

Figure 4:
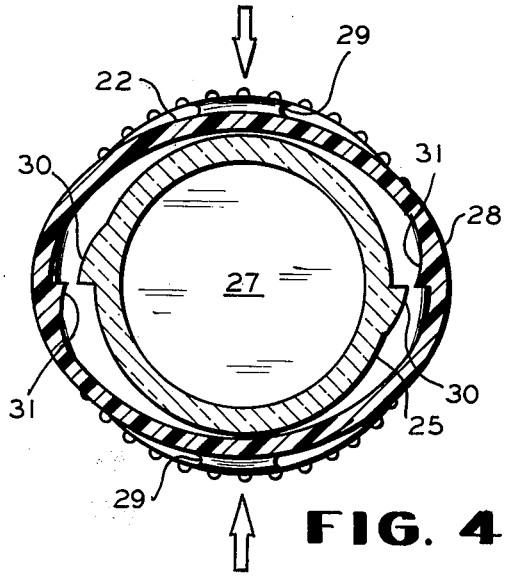
FIG. 4 is a view similar to FIG. 3 but illustrating how the child-resistant means are disengaged in order to enable retrograde rotation of the cap relative to the container neck.

When a child of an age greater than six years or so, or an adult, desires to gain access to the contents of the container closed by this embodiment of the invention, the person disengages the child-resistant locking teeth 30 and 31 by squeezing inwardly in the direction shown by the arrows in FIG. 4, from opposite sides of the collar 28, to bulge the collar 28 outwardly in a direction normal to the direction of squeezing as shown in FIG. 4. This moves the locking teeth 31 radially outwardly, disengaging them from the locking teeth 30, and the person may then rotate the cap 20 and collar 28 in a retrograde direction to remove it from the container neck 25.

When the person desires to restore the cap 20 to the container neck 25, it is necessary only to rotate the cap 20 downwardly onto the neck 25, turning it until resistance to its further rotation indicates that the liner 27 has been squeezed tightly against the container neck 25 and the snapping effect of the teeth 31 passing the teeth 30 tells the person that the cap has been restored to child-resistant and liquid tight position.

Figure 5:
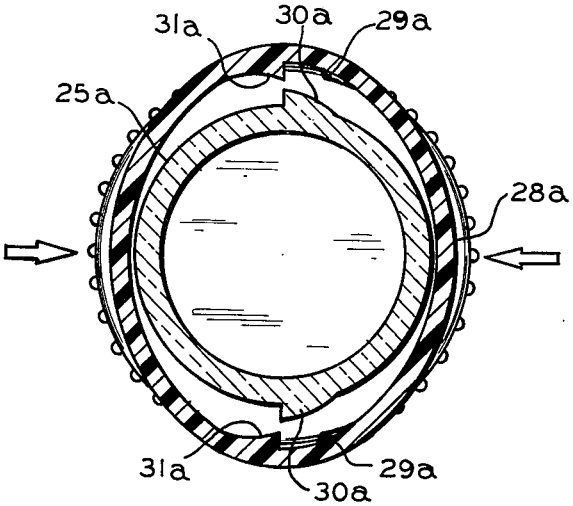
FIG. 5 is a view similar to FIG. 4 but illustrating a second embodiment of the invention.

The embodiment of the invention illustrated in FIG. 5 differs from that of FIGS. 1 – 4, inclusive, only in one way. It will be observed in FIGS. 1 – 4 that the webs 29 are positioned diametrically opposed from each other and located at 90° away from the locations of the teeth 31 on the collar 28. In an arrangement complementary thereto, of course, the teeth 30 on the container neck 25 are so positioned as to be engaged by the teeth 31, as illustrated in FIG. 3, when the cap 20 is in liquid tight position on the container neck 25.

In contrast, in the embodiment illustrated in FIG. 5, teeth 31*a* on a collar 28*a* are positioned immediately below webs 29*a* rather than being positioned 90° therefrom. Similarly, therefore, teeth 30*a* on a container neck 25*a* are so positioned as to be engaged by the teeth 31*a* when the cap is in liquid tight position. Again, the flexibility of the two connecting webs 29*a* and the skirt 28*a*, itself, provides for disengagement of the child-resistant means consisting of the teeth 30*a* and 31*a* by squeezing the collar 28*a* inwardly in the direction shown by the arrows in FIG. 5 to bulge it outwardly in the direction normal thereto, thereby to disengage the teeth 30*a* and 31*a* and allow a person to turn the cap and the skirt 28*a* in a retrograde direction.

In both the embodiment of FIGS. 1 – 4, inclusive, and that of FIG. 5, the collar 28 or 28*a* is annular in shape and of the same outside diameter as the cap skirt 22.

Figure 6:
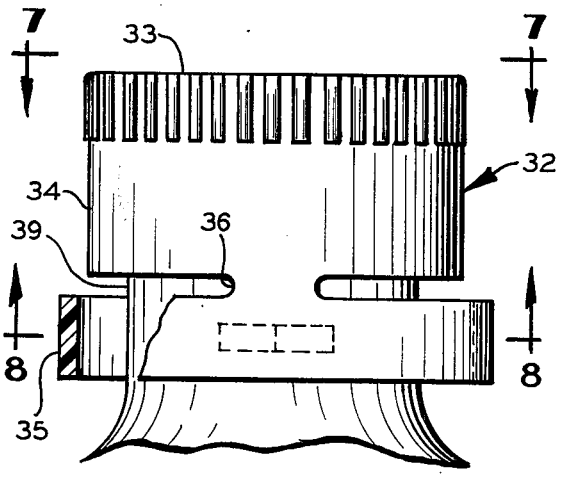
FIG. 6 is a fragmentary view in side elevation showing a third embodiment of the invention, with parts broken away.
Figure 7:
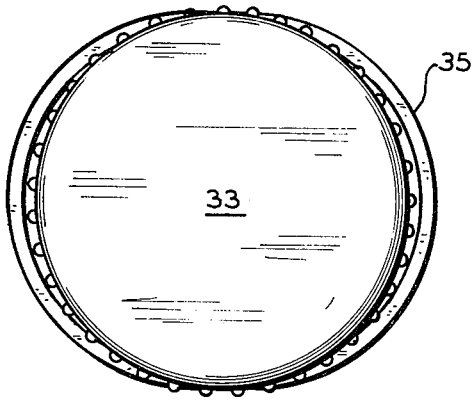
FIG. 7 is a top, plan view of the cap comprising a part of the invention as shown in FIG. 6.
Figure 8:
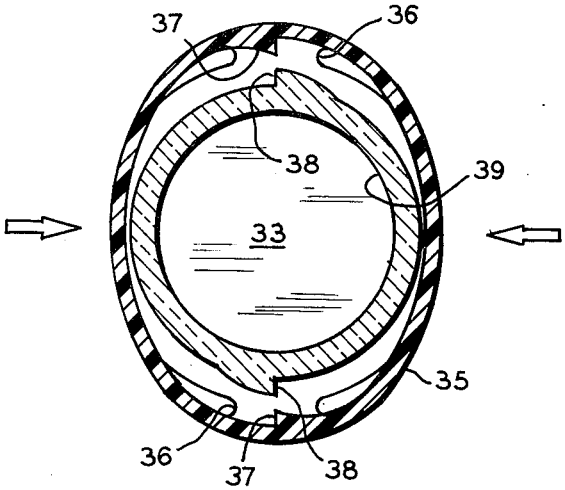
FIG. 8 is a horizontal sectional view taken along line 8—8 of FIG. 6 and illustrating how the child-resistant means of the invention are disengaged.

In a third embodiment illustrated in FIGS. 6 – 8, inclusive, a cap 32 has a top 33 and an annular skirt 34. A locking collar 35 is connected to the lower margin of the skirt 34 by a pair of flexible webs 36, similar to the webs 29 and 29*a*, but the locking collar 35 is slightly oval in shape as can best be seen in FIG. 7. In this embodiment cooperating child-resistant teeth 37 and 38 on the collar 38 and a container neck 39 are similar to the locking teeth 30–31 or 30*a*–31*a* of the earlier described embodiments of the invention.

Again, the cap 32 may be threaded downwardly onto the container neck 39 in the conventional fashion and after being sealed, and engagement of the child-resistant locking means 37 and 38, cannot be removed without the special action described above. In this instance, the locking collar 35 is squeezed inwardly in a direction of its longer axis, as indicated by the arrows in FIG. 8, to bulge the collar 35 outwardly in a direction normal thereto disengaging the teeth 37 and 38 so that the cap 32 can be rotated in a retrograde direction for its removal.

Figure 9:
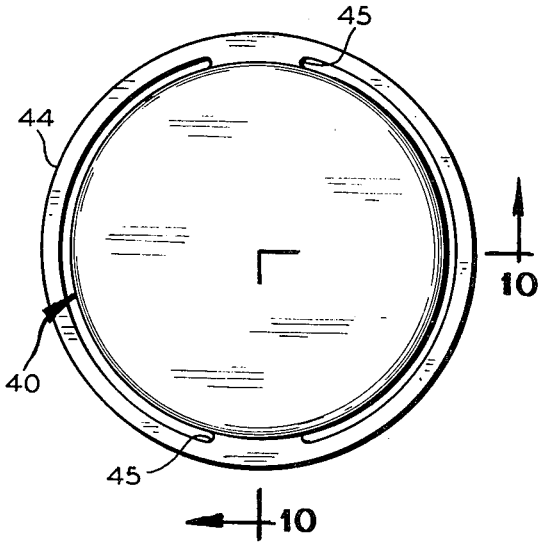
FIG. 9 is a top plan view of a cap comprising a part of a fourth embodiment of the invention.
Figure 10:
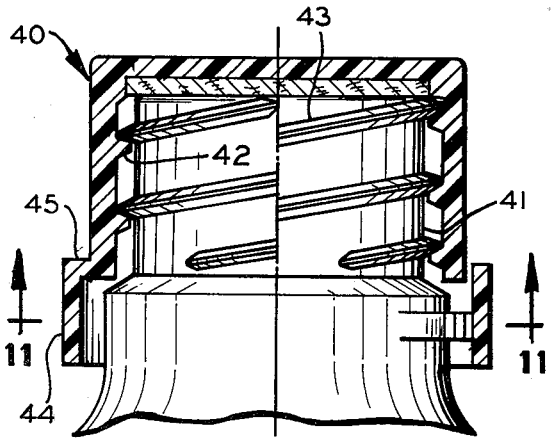
FIG. 10 is a fragmentary, vertical sectional view taken along the line 10—10 of FIG. 9 and showing the child-resistant means engaged.
Figure 11:
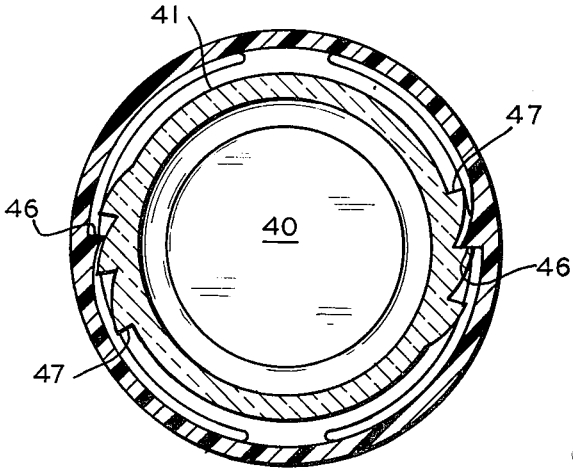
FIG. 11 is a horizontal sectional view taken along the line 11—11 of FIG. 10.

A fourth embodiment of the invention is illustrated in FIGS. 9 – 11 inclusive. In this embodiment of the invention a cap 40 and a container neck 41 are shown as having multi-start threads 42, on the interior of the skirt of the cap 40, and 43 on the container neck 41. Whether to use single start threads as illustrated, for example, in FIG. 2, or multi-start threads as illustrated in FIG. 10, is a mere matter of choice and does not, in itself, constitute any part of the instant invention.

As in the earlier described embodiments of the invention, that of FIGS. 9 – 11, inclusive, also comprises a locking collar 44 that is connected to the lower margin of the skirt cap 40 by flexible webs 45 but, in this embodiment, the webs extend radially outwardly. The inside diameter of the collar 44 is larger than the outside diameter of the main body of the cap 40 and, of course, the outside diameter of the collar 44 is still larger.

As in the earlier described embodiments of the invention, the locking collar 44 and the container neck 41 have cooperating child-resistant locking means consisting of inwardly directed teeth 46 on the locking collar 44 and outwardly directed teeth 47 on the container neck 41.

In FIG. 11 a plurality of teeth 47 are illustrated on each side of the container neck 41 and, it will be observed, that their latching faces are not diametrically opposed to each other but are slightly staggered away from diametric opposition so that the child-resistant action of the opposed teeth 46 and 47 will be effective in a plurality of positions of the cap 40 on the container neck 41.

The staggered relationship of the teeth 47 on opposite sides of the container neck 41, and the provision of several teeth 47 on each side, compensates for manufacturing tolerances in both the cap 40 and container neck 41 which may upon occasion accumulate and result in the cap 40 not reaching liquid tight position in exactly the same angular relationship relative to the container neck 41 in each and every instance. The non-alignment diametrically of the teeth 47 also insures that one of the teeth 47 will engage one of the teeth 46 on at least one side of the cap 40 even though the cap 40 may be tightly screwed down onto the container neck 41 to a relative angular position such that the cooperating teeth 46 – 47 on the opposite side of the cap 40 are not interengaged.

Having described my invention, I claim:

1. A cap and neck finish for a container having a threaded neck, a. said cap having a disc-like top, an annular skirt and a depending collar at the lower margin of said skirt, b. two diametrically opposite flexible webs unitarally connecting said skirt and said collar, c. threads on the interior of said skirt mating with the threads on said container neck, and d. co-operating child-resistant locking means on opposite sides of the exterior of said container neck and on opposite sides of said collar that are engaged when said cap reaches sealed position on said container neck and are disengageable by inward flexure of opposite sides of said collar in a direction normal to a diameter extending between the child-resistant locking means on said collar.

2. A cap and neck finish according to claim 1 in which the elements of the child-resistant locking means which are on the collar are located opposite each other and 90° away from the webs connecting said collar to the cap skirt.

3. A cap and neck finish according to claim 1 in which the flexible webs extend axially relative to the cap skirt and the collar has an outside diameter the same as the outside diameter of said skirt.

4. A cap and neck finish according to claim 1 in which the child-resistant locking means consist of ratchet-like teeth on the exterior of the container neck and similar, oppositely directed, co-operating ratchet-like teeth on the interior of the collar.

5. A cap and skirt combination according to claim 4 in which there is a plurality of teeth on the opposite sides of at least one of the container neck and collar, whereby said teeth are engageable at various relative angular positions of said cap and container neck.

* * * * *